United States Patent [19]

Rhodes et al.

[11] 4,096,723

[45] Jun. 27, 1978

[54] TOOL ASSEMBLY FOR FORMING INTERNAL GROOVES IN TUBES

[75] Inventors: Robin B. Rhodes, Ogdensburg; Paul Vobecky, Lafayette, both of N.J.

[73] Assignee: Isothermics, Inc., Augusta, N.J.

[21] Appl. No.: 769,795

[22] Filed: Feb. 17, 1977

[51] Int. Cl.[2] ..... B21H 3/08

[52] U.S. Cl. ..... 72/123; 72/125; 72/436

[58] Field of Search ..... 72/84, 123, 125, 370, 72/436; 10/89 R, 89 P, 129 R, 129 P, 152 T; 104/147 R, 164

[56] References Cited

U.S. PATENT DOCUMENTS

| | | | |
|---|---|---|---|
| 335,727 | 2/1886 | Voigt | 72/123 |
| 1,081,916 | 12/1913 | Sampson | 10/89 R |
| 1,510,084 | 9/1924 | Brainerd et al. | 10/89 R |
| 2,611,413 | 9/1952 | Molinare | 72/125 |
| 2,927,372 | 3/1960 | Powell | 72/84 |
| 3,177,691 | 4/1965 | Koehler | 10/152 T |

*Primary Examiner*—Lowell A. Larson

*Attorney, Agent, or Firm*—Mel K. Silverman; David A. Jackson; Richard M. Goldberg

[57] ABSTRACT

A tool assembly for forming internal threads on the interior surfaces of tubular structures which comprises a substantially cylindrical tool holder defining circumferentially about one end thereof, a plurality of disc-shaped forming edges, said tool holder adapted for rotational contact with a tubular workpiece, a rotating means located in operative contact with said tool holder, said rotating means situated for longitudinal reciprocation along an inclined track, a workpiece securement means comprising opposed clamps or the like located on a base structure and adapted to secure said workpiece in axial alignment with said tool holder, and a track comprising paired track members or rails associated with said workpiece securement means, wherein said securement means and said track are inclined with respect to the horizontal whereby said workpiece is apically situated with respect to said track to enable said tool holder to traverse the interior of said workpiece while moving on said track. The tool holder of the present invention is of simple construction and confers an economy of processing.

16 Claims, 10 Drawing Figures

TOOL ASSEMBLY FOR FORMING INTERNAL GROOVES IN TUBES

BACKGROUND OF THE INVENTION

The present invention relates to tools for thread forming, and more particularly to those tools which may be employed to inscribe internal threads in tubular objects.

The prior art recites numerous well known methods and related apparatus for the formation of threads or grooves on solid material. Specifically, thread forming is generally accomplished by a lathe which inscribes a helical groove about a cylindrical object as it is rotated thereagainst. Thread forming or thread rolling is basically a cold forging process in which a thread is formed by the displacement of material from the workpiece. Certain advantages of such processes, such as accuracy, uniformity and smoothness are recognized commerical expedients which have come to be expected of an acceptable thread forming process. Generally such processes have been limited to the provision of external threads as the accuracy and the scrap removal aspects of such processes have posed major commercial problems.

Recently, several processes and apparatus have been devised for the inscription of threads on the interior of the tubular structure. Specifically, one particular system achieves the inscription of internal threads by the means of a rotating shaft disposed inside the tubular workpiece which defines a fixed cutter therein said cutter having a beveled edge which achieves the inscription of the groove. The cutter situated within the shaft rotates while the tube workpiece is moved linearly past so that the groove is cut in the tube. Another system employs a free rotating tubular tool holder which is situated in contact with a workpiece maintained under rotation, whereby the cutter is moved linearly through the workpiece to effect the grooving operation.

All of the foregoing processes and related apparatus, though capable of inscribing acceptable grooves or threads in tubular workpieces, have been judged deficient in that they require the preparation and operation of a complex apparatus requiring substantial cost and maintenance. Thus, for example, the latter above-mentioned process would require the employment of a full lathe for its operation, which can clearly be seen to be substantially cost intensive. Further, none of the prior art processes and apparatus define an operative energy saving process which further enhances the quality of the product produced by the use of a noninjurious lubrication means disposed at the cutting tool edge.

The present invention is believed to address itself successfully to the resolution of the foregoing difficulties.

SUMMARY OF THE INVENTION

In accordance with the present invention, a tool assembly is disclosed which comprises a substantially cylindrical tool holder defining circumferentially about one end thereof, a plurality of disc-shaped forming edges, said tool holder adapted for rotational contact with a tubular workpiece, a rotating means located in operative contact with said tool holder, said rotating means situated for longitudinal reciprocation along an inclined track, a workpiece securement means comprising opposed clamps or the like located on a base structure and adapted to secure said workpiece in axial alignment with said tool holder, and a track comprising paired track members or rails associated with said workpiece securement means, wherein said securement means and said track are inclined with respect to the horizontal whereby said workpiece is apically situated with respect to said track to enable said tool holder to gravitationally traverse the interior of said workpiece while moving on said track. The tool holder of the present invention is of simple construction and confers an economy of processing.

The present invention requires little or no energy expenditure, as the linear movement of the tool holder is developed through rotational contact with the workpiece. The tool holder support or trolley is of durable construction and is adapted to roll freely upon the tracks to enable the movement of the tool holder respecting the workpiece.

Accordingly, it is a principal object of the present invention to provide the tool assembly which economically and rapidly achieves the inscription of internal threads on tubular structures.

It is a further object of the present invention to provide a tool assembly as aforesaid which achieves the inscription of internal threads with a minimum expenditure of energy.

It is yet a further object of the present invention to prepare a tool assembly as aforesaid which accomplishes the inscription of internal threads to exacting tolerances with a minimum of scrap generation.

Other objects and advantages will be apparent to those skilled in the art upon the consideration of the ensuing description which proceeds in conjunction with the following illustrative drawings.

DETAILED DESCRIPTION

In accordance with the present invention, the foregoing objects and advantages are readily attained.

Figure 1:
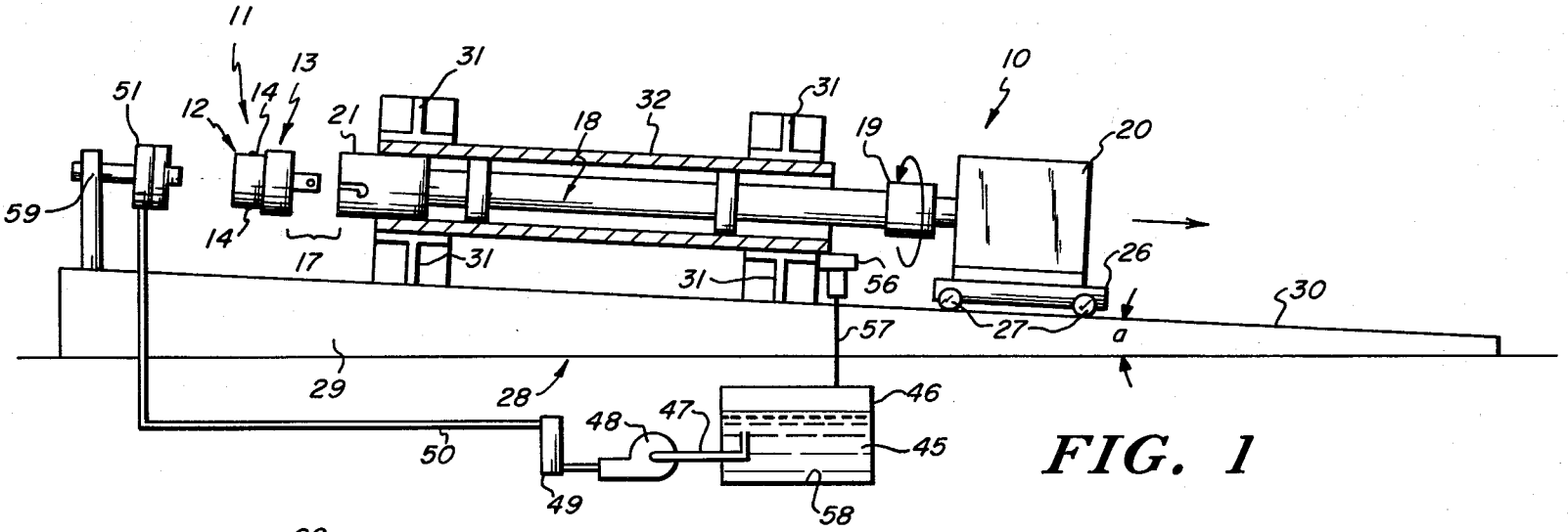
FIG. 1 comprises a schematic side view, partly sectioned and partly in phantom illustrating the tool assembly of the present invention.
Figure 2B:
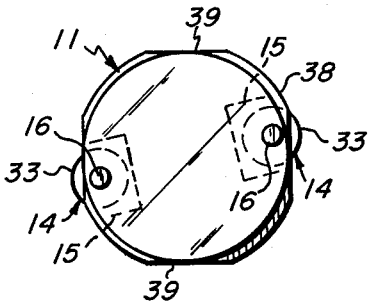
FIG. 2B is an end view illustrating the forming end of the tool holder.

Referring now to the FIGS., wherein like numerals designate like parts, FIG. 1 comprises a side shcematic view partly in section illustrating the assembly in accordance with the present invention. Tool assembly 10 is seen to comprise the generally cylindrical tool holder 11 which houses the forming means of the present invention at one end thereof. Tool holder 11 comprises a forming end designated 12 and an actuating end 13. At forming end 12, forming wheels 14 are situated within complementary recesses 15, both shown in greater detail in FIG. 2A, whereby forming wheels 14 are free to rotate therewithin on individual axles 16 as illustrated in FIG. 2B. The structure and operation of forming wheels 14 will be dealt with in greater detail later on.

At actuating end 13, tool holder 11 is adapted to establish a bayonet-type linkage 17 with rotator connecting means 18 comprising an extensible shaft which is positively connected at junction 19 to rotating means for rotational actuator 20. Connecting means 18 is provided at the free end thereof with a complementary female receptacle 21, shown in greater detail in FIg. 4, which defines an opening 22 shown in phantom, and J-shaped locking slots 23 journaled through diametrically opposed wall portions of female receptacle 21. The corresponding bayonet structure is located as actuating end 13 of tool holder 11 and comprises a male inserter 24 provided with means for engaging slots 23 comprising a dowl 25 situated within inserter 24 in a direction transverse to the axis thereof. Locking engagement of linkage 17 is thus achieved by the insertion of inserter 24 into receptacle 21 whereby the ends of dowl 25 pass through slot 23. Locking is then achieved by a simple turn of holder 11 whereby the ends of dowl 25 reside within the reduced portion of slots 23. Slots 23 are provided in a configuration whereby the J portion thereof is directed oppositely to the direction of rotation of said tool holder. This engagement is thus rapidly achieved by merely turning tool holder 11 to free dowl 25 from engagement with the J portion of slot 23, followed by the withdrawal of inserter 24 from receptacle 21. Though the foregoing discussion has described a quick connecting means employing a bayonet-type arrangement, it is to be understood that the invention is not limited thereto, as other quick connecting means not shown herein may be substituted therefor which provide essentially the same rapid disengagement of tool holder 11 from rotator connecting means 18.

Rotational actuator 20 is situated axially removed from tool holder 11 and is adapted for translational reciprocation in a direction parallel to its axis of rotation. Specifically, actuator 20 is provided on a free moving dolly 26 which is provided with reduced-friction wheels 27 to facilitate its free movement in the aforementioned translational axial direction. The provision of actuator 20 in this freely rollable mode is one of the characterizing features of the present invention, since, as will be shown in the ensuing description, the actuator is capable of moving in a translational direction to effect the movement of tool holder through the workpiece.

Tool assembly 10 further comprises base structure 28 which, in turn, comprises supporting structure 29 and track members 30. Supporting structure 29 is provided with a workpiece securement means comprising in the illustration clamps 31 which may be anchored thereto. Clamps 31 as illustrated comprise coacting jaw-like structures which are either manually engaged or, alternatively, may be actuated by means not shown such as hydraulic or pneumatic actuation. Clamps 31 secure the workpiece 32 in a position of axial alignment with tool holder 11 and its associated components for the purpose of permitting the accurate movement of holder 11 through the interior of the workpiece. Track members 30 are associated and integral with supporting structure 29 and provide the area of travel for actuator 20 as it draws tool holder 11 through workpiece 32. Base structure 28 is inclined at an angle designated A which may vary up to 30° or more to facilitate the gravitational counter-balance of the frictional resistance encountered by actuator 20. It can be seen that the angle A may vary in accordance with the nature of the workpiece and the cutting operation to be conducted, whereby, a tubular workpiece offering greater frictional resistance to the forming operation may require a greater incline for the successful translational motion of tool holder 11 therethrough. The foregoing determination can be readily made by one skilled in the art. It is this apparent that the placement of base structure 28 at an incline with respect to the horizontal results in the location of the workpiece and its securement means comprising clamps 31 in a position which is apically situated with respect to track members 30 whereby actuator 20 is encouraged to draw tool holder 11 through workpiece 32, so that additional motor actuation or complicated machinery appears unnecesary to effect the thread forming process employed with the assembly disclosed herein. This is clearly one of the characterizing features and advantages of the assembly and associated method of the present invention.

Figure 2A:
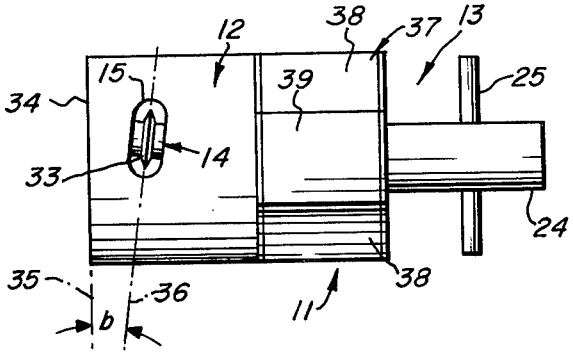
FIG. 2A is a side view of the tool holder of the present invention.
Figure 3A:
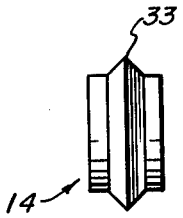
FIG. 3A comprises a side view of a forming wheel employed in the tool holder of the present invention.
Figure 3B:
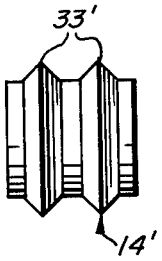
FIG. 3B comprises a variant forming wheel employable in accordance with the present invention.

A further characterizing feature of the assembly of the present invention comprises the structure of tool holder 11. Referring now to FIGS. 2A and 2B, tool holder 11 is seen to comprise an essentially cylindrical device having a frontal forming end 12 and a rearward plate actuating end 13. Forming end 12 is provided with recesses 15 which are adapted to replaceably house forming wheels 14. Forming wheels 14 are secured within recesses 15 by axles 16 which may comprise pins or screws interference fit within complementary channels not illustrated, in forming end 12. Referring to FIGS. 2A and 3A, forming wheel 14 defines an increased diameter forming edge 33 which is shaped as illustrated to define the angularity of the resulting thread or groove. Thus, edge 33 may be situated at a variation of angles with respect to wheel 14 to account for desired variations in thread or groove pitch. Further, and with respect to FIG. 3B, a forming wheel may be employed which defines two or more such forming edges, such as forming edges 33'. In such an instance wherein a plurality of forming wheels are employed with a corresponding plurality of forming edges, a greater number of grooves or threads per unit length of tubular workpiece may be simultaneously inscribed. Thus, very exacting thread or groove tolerances may be achieved by the simple variation of the tool holder of the present invention to accommodate a plurality of equally spaced cutting wheels. For purposes of illustration, however, the attached FIGS. relate to the provision of two such forming wheels in tool holder 11, however, the invention is clearly not limited thereto.

As noted earlier, forming wheels 14 may be disposed at an angle with respect to the central axis of tool holder 11. Specifically, forming wheels 14 are circumferentially mounted about holder 11 but are disposed as a small skew angle with respect to the central axis of holder 11. Referring again to FIG. 2A, this skew angle is measured for purposes of ease of illustration by the intersection of respective planes containing the frontal face 34 of holder 11 and forming edge 33. Both planes are represented by respective dotted lines 35 and 36 and are seen to define an included angle B which may have any suitable value depending on the pitch of the desired thread. Generally, angle B may vary from 0° to N degrees, where N is the normal helix angle of the desired thread. More particularly, the pitch or angle desired in the use of the present apparatus in the manufacture of internal threads for heat pipes and the like may range up to about 2°, and generally between ½° and 1½°. This angle, like the angle in displacement of forming edges 33, is variable in accordance with any particular workpiece, and the invention should not be limited thereto.

Referring further to FIGS. 2A and 2B, holder 11 defines at the intermediate area thereof a highly increased diameter guide portion 37 which defines rounded arc-shaped bearing surfaces 38 which are provided in close correspondence to the internal diameter of the workpiece. Flat portions 39 are provided to maintain guide portion 37 out of contact with the interior of the workpiece to reduce frictional resistance which may develop as a result of the contact with the interior surface. By this means, tool holder 11 is maintained in alignment with the interior of the workpiece to facilitate the accurate inscription of the grooves or threads.

Figure 4:
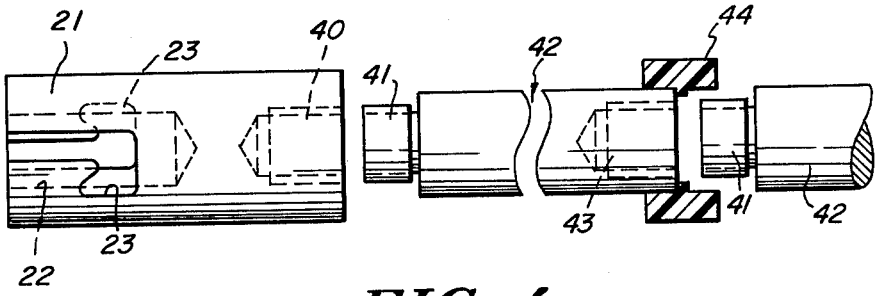
FIG. 4 comprises a broken side view partly sectioned and partly in phantom illustrating acting means provided between said tool holder and said rotating motive means.

In conjunction with the alignment means employed with tool holder 11, and referring now to FIG. 4, connecting means 18 is illustrated in greater detail which comprises a segmented structure facilitating its variation in length to accommodate variation in workpiece size as well as other attendant variables connected with the employment of the present assembly. Female receptacle 21 is thus seen to possess a threaded orifice 40 shown in phantom which mates with the screw threadable bolt 41 comprising the leading edge of extension 42. Extension 42 is likewise provided, at the opposite end thereof, with a threaded orifice 43, which may be attached to a similar extension 42 for additional length of the connecting means intermediate extension 42, at the screw threaded joints thereof, are placed alignment means comprising increased diameter bearing structures 44 which serve to align connecting means 18 within the workpiece as well as to permit excessive width or vibration of the connecting means during rotation.

Figure 5:
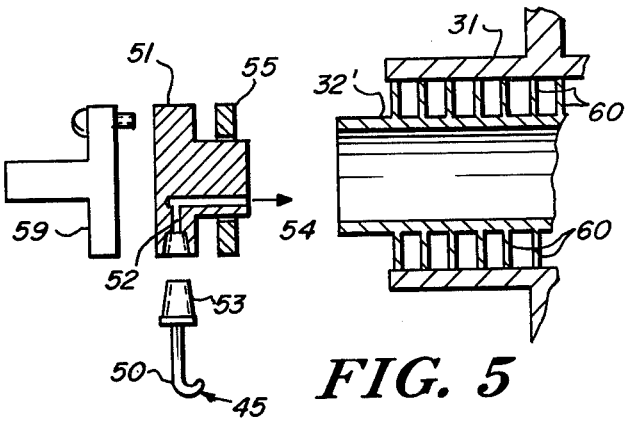
FIG. 5 is an exploded side sectional view partly broken away illustrating the placement of the cooling means employed in accordance with the present invention.

Referring now to FIGS. 1 and 5, a further characterizing feature of the present invention is disclosed which comprises the unique cooling means associated with the workpiece. First, coolant 45 is stored and circulated through reservoir 46 shown schematically as below base structure 28 in FIG. 1. In operation, coolant 45 is circulated via conduit 47 into pump 48 and then through filter 49 to remove sediment which may have developed from passage through the workpiece during the forming operation. Upon exiting filter 49 the coolant travels through conduit 50 into coolant nozzle 51. Coolant nozzle 51 is seen in greater detail in FIG. 5 to comprise an essentially T-shaped structure which has passing therethrough an L-shaped cooland conduit 52. Coolant 45 thus enters conduit 52 via screw threaded entrance port 53 and is circulated through the interior of the workpiece upon the firm engagement under pressure of coolant nozzle against the opening 54 of workpiece 32. A leak-proof seal is assured by the employment of circular gasket 55 resting upon nozzle 51. Cooland 45 is thus pumped through the workpiece 32 where it contacts the forming edges 33 and serves both to cool the forming operation as well as to lubricate the forming surfaces and provide a wash which carries away scrap generated by the forming operation. Cooland 45 thus flows through workpiece 31 and is collected at the opposite end of workpiece 31 by trough 56, where it is then directed through pipe 57 to reservoir 46. Sediment resulting from the forming operation develops at the bottom reservoir 46 as designated by darkened area 58. Coolant nozzle 51 is generally brought into engagement with workpiece 31 after tool holder 11 has passed beyond end 54 thereof. Nozzle 51 may be manually applied or as schematically illustrated in FIG. 1, may be provided with motor actuation whereby it may reciprocate automatically into and out of contact with workpiece 31. Such actuation may assume the form of either mechanical, electrical or pneumatic actuation such as schematically depicted in FIGS. 1 and 5 as element 59.

As noted above, the coolant 45 may comprise a fluid which has both cooling as well as lubricating properties. In this connection, and specifically with respect to a particular utility of the apparatus and method of the present invention, the coolant may comprise a wide variety of fluids such as, water, alcohol and the like and preferably may comprise a material known as Freon® which generally comprises dichlorodifluoromethane. Particular variations of Freon® commercially available as R-11 and R-113 may be well suited in the instance where the tubular workpiece under inscription is to be used as a heat pipe, as the particular materials recited above are likewise useful as transfer media. Though the disclosure has recited specific materials comprising the Freon® group, it is to be understood that other fluorocarbons may be equally as useful, as well as the other materials specified earlier, to serve as coolants as well as lubricants. Accordingly, the specification should not be limited to a particular coolant as a wide variety are clearly contemplated herein.

Figure 6:
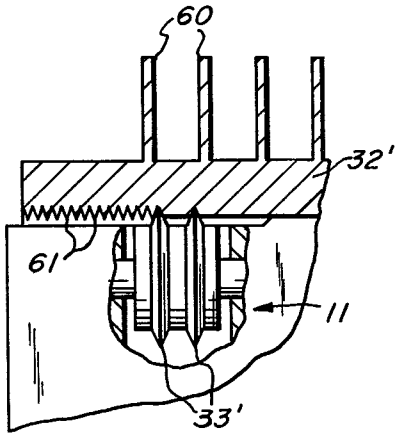
FIG. 6 is a side sectional schematic view illustrating the operation of the forming discs in relation to the interior surface of the tubular workpiece.

The operation of the tool assembly of the present invention comprising the method associated therewith commences with the positioning and clamping of the tubular workpiece in clamps 31 as illustrated in FIG. 1. Subsequently, the rotational actuator 20 is brought into position adjacent the tubular workpiece whereby connecting means extends through the interior surface thereof and emerges from the opposite end. Rotational actuator 20 is then held in position while tool holder 11 is affixed to connecting means 18 by the engagement of bayonet link 17. Actuator 20 is then started and permitted to roll down track 30 whereby tool holder 11 moves within the workpiece and commences its inscription. At this point coolant nozzle 51 is placed into engagement with the end of the workpiece and the circulation of coolant is thereafter commenced. As tool holder 11 passes through the interior surface of the workpiece, forming wheels 14 rotate freely whereby forming edges 33 exert a cold forging upon the interior surface which results in the formation of the corresponding grooves. This process is illustrated with respect to a workpiece having exterior fins 60 in FIG. 6. Herein a broken view of a tool holder 11 is shown which employs a forming wheel defining two forming edges which are inscribing V-shaped threads 61 on the interior surface of the workpiece. The provision of the exteriorly finned workpiece 32' is illustrated herein as it is characteristic of the heat pipe frequently machined by this process. Correspondingly, a similar such finned structure is illustrated in FIG. 5 wherein the coolant nozzle and assembly were described.

Figure 7B:
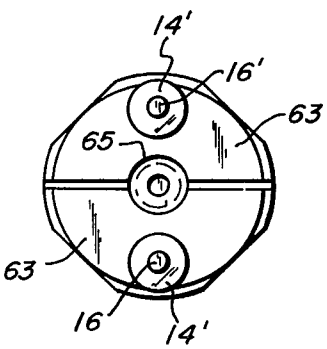
FIG. 7B is an end view of the tool holder of FIG. 7A illustrating the front face of the tool holder.
Figure 7A:
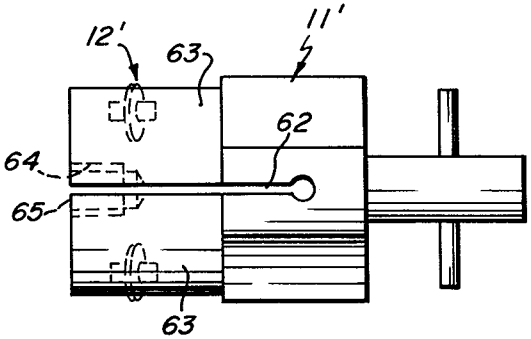
FIG. 7A comprises a side view partly in phantom illustrating a variant tool holder employable in accordance with the present invention.

In accordance with an alternate embodiment of the present invention, tool holder 11 may assume a variant construction which allows for its radial adjustability to accommodate tubular workpieces of variable diameter. Referring now to FIGS. 7A and 7B, tool holder 11' is seen to resemble in outward appearance tool holder 11 illustrated in FIGS. 2A and 2B. The variation in structure occurs with respect to forming end 12', wherein a longitudinally placed diametrically extending slot 62 is provided to split holder 11' into equal half cylinders 63. Referring now to FIG. 7B, an inclined bore 64 is provided which is coaxial with the central axis of tool holder 11, which extends partly through cutting end 12'. Bore 64 is inclined and provided with threads for the association with an appropriately threaded screw cam 65. Cam 65 is thus placed into engagement with bore 64, and may be driven within or retracted appropriately to cause half cylinders 63 to move radially away from or toward each other. The adjustment of screw cam 65 thereby accounts for variations in the interior diameter of a given workpiece. Though the illustrations in FIGS. 7A 7B have proceeded with respect to the division of the forming end into two equal half cylinders, it is to be understood that a greater number of such equal divisions may be employed to achieve a finer adjustment capability in the context of multiple forming wheels. Accordingly, the invention is not to be limited by the illustrations shown herein.

While there have been herein shown and described the preferred embodiments of the present invention, it will be understood that the invention may be embodied otherwise that as herein specifically illustrated or described and that within said embodiments certain changes in the detail and construction, and the form of arrangement of the parts may be made without departing from the underlying idea or principles of this invention within the scope of the appended claims.

We claim:

1. A tool assembly for forming internal grooves on the interior surfaces of tubular workpieces which comprises an essentially cylindrical tool holder, having a forming end and an actuating end, said tool holder housing at said forming end a plurality of disc-like forming wheels, said wheels rotatably mounted circumferentially about said holder within recesses provided therein whereby said wheels partially protrude from the permiter of said tool holder, and wherein the central axes of said wheels and the central axis of said holder are longitudinally coplanar but are respectively uniformly disposed at a predetermined skew angle, a tool holder support comprising rotating motive means detachably connected to said tool holder at said actuating end, said rotating motive means comprising a rotational actuator rollably mounted for the axial movement of said tool holder longitudinally through a tubular workpiece in contact with the interior surface thereof, and a longitudinally extended base structure, said base structure defining means at one end thereof for the support and securement of said tubular workpiece in axial alignment with said tool holder, said base defining along the remainder of the longitudinal dimensions thereof a travelway for said tool support, said travelway comprising paired track members facilitating the rollable movement of said tool support thereon, said base further disposed at angle with respect to the horizontal whereby said workpiece securement means is apically located with respect to said track members.

2. The tool assembly of claim 1 further including means for circulating coolants through said tubular workpiece, said means comprising a coolant reservoir operatively connected to a coolant nozzle, said coolant nozzle comprising disc-shaped member with T-shaped cross-section defining therein a conduit for the passage therethrough of coolant, said nozzle adapted to be firmly tensioned against the highermost end of said workpiece.

3. The assembly of claim 2 wherein said coolant is selected from the group consisting of water, alcohol, and fluorocarbon liquids.

4. The tool assembly of claim 1 wherein said tool holder support further comprises a flat bed dolly having paired wheels placed thereon which support said actuator and provides the means for translational movement thereof.

5. The tool assembly of claim 1 wherein said skew angles may range up to about 2°.

6. The tool assembly of claim 5 wherein said skew angles may range from ½° to 1½°.

7. The tool assembly of claim 1 wherein said tool holder is detatchably connected to said tool holder support by a bayonet-type linkage.

8. The tool assembly of claim 1 wherein said tool holder and tool holder support are connected by means of a plurality of extension connectors located therebetween.

9. The tool assembly of claim 8 wherein guide members or bearings are provided intermediate respective extension connectors at the junction thereof.

10. The tool assembly of claim 1 wherein said forming wheels are displaced in radial, equidistant with respect to each other.

11. The tool assembly of claim 1 wherein said forming wheels each define a plurality of forming edges for inscription of said workpiece.

12. The tool assembly of claim 2 wherein said clamping means and said cooling means are provided with pneumatic actuation.

13. The tool assembly of claim 1 wherein said tool holder further possesses radial adjustment means within said forming end to enable the adjustment of said forming wheels in a radial direction coplanar with the central axis of said tool holder into contact with the interior surface of said tubular workpiece.

14. The tool assembly of claim 1 wherein said tubular workpiece comprises a heat pipe.

15. The tool assembly of claim 15 wherein said heat pipe possesses on the outer surface thereof radial projecting fin structures.

16. A tool for the inscription of internal grooves or threads within a tubular workpiece which comprises a tool holder having a forming end and an actuating end, said tool holder housing at said forming end a plurality of disc-like forming wheels, said wheels rotatably mounted circumferentially about said holder within recesses provided therein whereby said wheels partially protrude from the perimeter of said tool holder, and wherein the central axes of said wheels and the central axis of said holder are longitudinally coplanar but are respectively uniformly disposed at a predetermined skew angle;

an actuating end comprising an increased diameter guide portion located adjacent and integral with said forming end, said guide portion having a perimeter defined by a plurality of arc-shaped bearing surfaces, and a plurality of flattened areas disposed in alternation therewith said bearing surfaces; and detachable attachment means located integral and axially aligned with said guide portion which extends in the opposite direction to said forming end, for the detachable attachment of said tool holder to a means for the rotation thereof.

* * * * *